US010309637B2

(12) United States Patent
Zhang et al.

(10) Patent No.: US 10,309,637 B2
(45) Date of Patent: Jun. 4, 2019

(54) LOW PROFILE LIGHT WITH IMPROVED THERMAL MANAGEMENT

(71) Applicant: LEDVANCE LLC, Wilmington, MA (US)

(72) Inventors: Shiyong Zhang, Boxborough, MA (US); Golshan Coleiny, Boston, MA (US); Peter Stratemeyer, Westford, MA (US)

(73) Assignee: LEDVANCE LLC, Wilmington ( * ) Notice: Subject to any disclaimer, the term of this patent is extended or adjusted under 35 U.S.C. 154(b) by 226 days.

(21) Appl. No.: 14/727,775

(22) Filed: Jun. 1, 2015

(65) Prior Publication Data

US 2015/0345771 A1 Dec. 3, 2015

Related U.S. Application Data

(60) Provisional application No. 62/006,166, filed on Jun. 1, 2014.

(51) Int. Cl.

| | |
|---|---|
| ***F21S 8/04*** | (2006.01) |
| ***F21V 29/74*** | (2015.01) |
| ***F21V 21/03*** | (2006.01) |
| ***F21V 23/00*** | (2015.01) |
| ***F21V 29/507*** | (2015.01) |
| *F21Y 105/10* | (2016.01) |
| *F21Y 115/10* | (2016.01) |

(52) U.S. Cl.

CPC ..... *F21V 29/74* (2015.01); *F21S 8/04* (2013.01); *F21V 21/03* (2013.01); *F21V 23/007* (2013.01); *F21V 29/507* (2015.01); *F21Y 2105/10* (2016.08); *F21Y 2115/10* (2016.08)

(58) Field of Classification Search

CPC ..... F21S 8/026; F21V 23/007; F21V 23/009; F21V 21/03; F21V 21/04; F21V 21/042

USPC ..... 362/150, 148, 145

See application file for complete search history.

(56) References Cited

U.S. PATENT DOCUMENTS

| | | | | |
|---|---|---|---|---|
| 4,199,803 | A * | 4/1980 | Hunt, III | F21V 21/03 362/145 |
| 8,201,968 | B2 | 6/2012 | Maxik et al. | |
| 8,641,243 | B1 * | 2/2014 | Rashidi | F21S 8/02 257/712 |
| 8,672,518 | B2 | 3/2014 | Boomgaarden et al. | |
| 8,864,340 | B2 | 10/2014 | Holland et al. | |
| 8,967,844 | B2 | 3/2015 | Boomgaarden et al. | |
| 9,028,091 | B2 | 5/2015 | Holland et al. | |

(Continued)

*Primary Examiner* — Jong-Suk (James) Lee
*Assistant Examiner* — Christopher E Dunay
(74) *Attorney, Agent, or Firm* — Hayes Soloway PC

(57) ABSTRACT

An improved low profile light is provided. The low profile light includes one or more solid state light sources and a cover disposed in relation thereto, such that light emitted from the light sources passes through the cover. The low profile light also includes a driver, in a driver housing, that provides electrical power to the light sources. The low profile light also includes a housing. The housing includes a central portion with a first side and a second side; a lip that extends around an outer edge of the housing; a cover receptacle to receive the cover; an outer face that extends from the lip inward towards the cover receptacle; an inner surface that extends downward away from the central portion and upward towards the lip, so as to form a valley; and a fin that extends perpendicularly up from the central portion.

20 Claims, 5 Drawing Sheets

(56) References Cited

U.S. PATENT DOCUMENTS

| | | | | |
|---|---|---|---|---|
| 9,157,581 | B2 | 10/2015 | Boomgaarden et al. | |
| 2009/0086474 | A1* | 4/2009 | Chou | F21S 8/026 362/230 |
| 2009/0109693 | A1* | 4/2009 | Tseng | F21V 21/03 362/382 |
| 2011/0002130 | A1* | 1/2011 | Lai | H01R 33/96 362/382 |
| 2012/0127736 | A1* | 5/2012 | Hoetzl | F21V 19/0055 362/365 |
| 2012/0140490 | A1 | 6/2012 | Rowlette, Jr. et al. | |
| 2013/0170190 | A1* | 7/2013 | Song | F21V 21/044 362/147 |
| 2013/0265750 | A1* | 10/2013 | Pickard | F21V 21/088 362/184 |
| 2014/0160741 | A1* | 6/2014 | Blackstone | F21V 23/026 362/221 |
| 2014/0160772 | A1* | 6/2014 | Wu | F21S 8/026 362/373 |
| 2015/0003072 | A1* | 1/2015 | Chen | F21V 15/01 362/294 |
| 2015/0092421 | A1 | 4/2015 | Boomgaarden et al. | |
| 2015/0300622 | A1 | 10/2015 | Boomgaarden et al. | |
| 2016/0011358 | A1 | 1/2016 | Boomgaarden et al. | |

* cited by examiner

LOW PROFILE LIGHT WITH IMPROVED THERMAL MANAGEMENT

CROSS-REFERENCE TO RELATED APPLICATION

The present application claims priority of U.S. Provisional Application No. 62/006,166, entitled "LOW PROFILE LIGHT WITH IMPROVED THERMAL MANAGEMENT" and filed Jun. 1, 2015, the entire contents of which are hereby incorporated by reference.

TECHNICAL FIELD

The present invention relates to lighting, and more specifically, to low profile lights including solid state light sources.

BACKGROUND

Increased usage of solid state light sources (such as but not limited to light emitting diodes (LEDs), organic light emitting diodes (OLEDs), polymer light emitting diodes (PLEDs), organic light emitting compounds (OLECs), and the like, including combinations thereof) has resulted in the creation of many lighting devices that take advantage of the benefits of these light sources. One such lighting device is a low profile lighting device, which typically (but not always) occupies a recessed ceiling fixture, but has a low profile portion that sits beneath the ceiling, small enough to minimize disruptiveness and maintain aesthetics. Thus, it does not intrude very far into the room.

Such lights typically use thermal management elements designed to put as much heat as possible outside of the recessed ceiling fixture—that is, beneath the ceiling, where ambient air is available. In addition to removing the need to use a typical large, multiple-finned heat sink, this design also allows the low profile light to be installed within a junction box, instead of a recessed ceiling fixture, in locations where a recessed ceiling fixture is not available.

SUMMARY

Conventional techniques for managing heat in low profile lighting devices suffer from a variety of deficiencies. For example, the thermal elements and structure of such devices to bring heat to the outside ambient air are either complicated and expensive, or are somewhat limited in the amount of heat they can dissipate; i.e., they are not as efficient. Complicated systems are not desirable in such lights, due to the potentially limited space in which the light is installed, and the desire to keep the profile of the light that is exposed beneath a surface such as a ceiling to a minimum for aesthetic reasons.

Embodiments improve such lights by extending one or more fins up (that is, above the ceiling) from the housing of the low profile light without removing the ability to install the low profile light within a junction box. The fin(s) and the housing are manufactured as a single part. This(these) fin(s) does(do) not like a traditional finned heat sink and, particularly in embodiments where the fin(s) correspondingly surround a driver housing, maintain a clean look for the light while showing improved heat dissipation.

In an embodiment, there is provided a low profile light. The low profile light includes: one or more solid state light sources; a cover disposed in relation to the one or more solid state light sources such that light emitted by the one or more solid state light sources passes through the cover; a driver to supply electrical power to the one or more solid state light sources, wherein the driver is contained within a driver housing; and a housing including: a central portion having a first side and a second side; a lip, wherein the lip extends around an outer edge of the housing; a cover receptacle configured to receive the cover; an outer face, wherein the outer face extends from the lip inward towards the cover receptacle; an inner surface, wherein the inner surface extends downward away from the central portion and upward towards the lip, so as to form a valley; and a fin, extending perpendicularly up from the central portion.

In a related embodiment, the central portion of the housing may be substantially flat. In another related embodiment, the central portion of the housing may be substantially flat on the first side. In a further related embodiment, the central portion of the housing may include a raised portion on the second side. In a further related embodiment, the raised portion may include a Y-shaped raised portion formed of three legs, the three legs meet at a center of the second side of the central portion, and the three legs each extend beyond the central portion to an inner edge of the lip.

In still another related embodiment, the one or more solid state light sources may be coupled to the first side and the driver housing may be coupled to the second side. In yet another related embodiment, the fin may be integrally formed with the central portion of the housing. In a further related embodiment, the fin may be shaped to at least partially surround a portion of the driver housing. In another further related embodiment, the fin may be substantially curved. In a further related embodiment, the driver housing may be correspondingly curved.

In another further related embodiment, the fin may include a first fin and a second fin, the first fin may be shaped to at least partially surround a first portion of the driver housing and the second fin may be shaped to at least partially surround a second portion of the driver housing. In a further related embodiment, the second fin may include a first raised portion, a second raised portion, and a connecting portion that joins the first raised portion to the second raised portion. In a further related embodiment, the connection portion may be lower in height than the first raised portion and the second raised portion. In a further related embodiment, the lowered height of the connection portion may be configured to receive a wire extending from the driver housing to a power source for the low profile light.

In still yet another related embodiment, the central portion, the lip, the cover receptacle, the outer face, the inner surface, and the fin may be integrally formed. In a further related embodiment, the central portion, the lip, the cover receptacle, the outer face, the inner surface, and the fin may be integrally formed of the same material.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
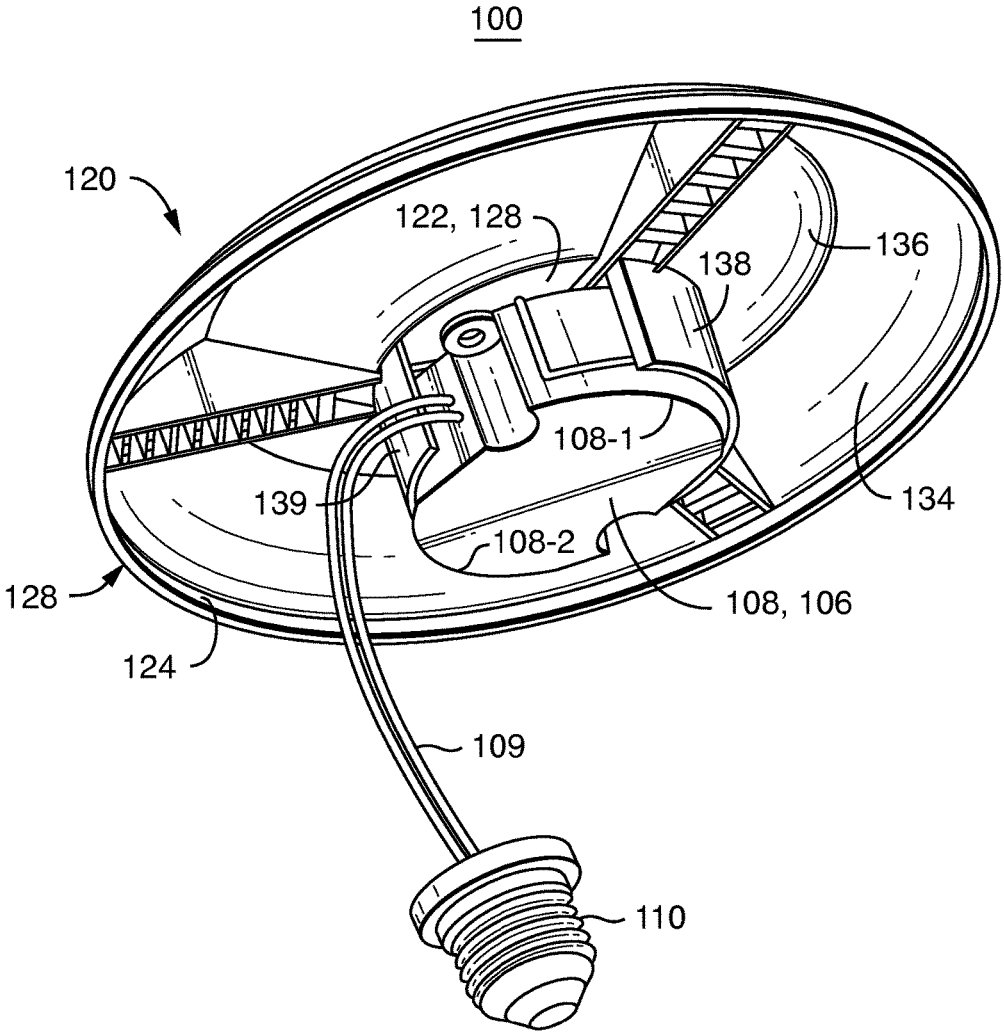
FIG. 1 shows a rear ceiling facing perspective view of a low profile light according to embodiments disclosed herein.

FIG. 1 shows a low profile light 100 from a rear, ceiling facing perspective view. That is, the portion of the low profile light 100 shown in FIG. 1 would generally not be visible when the low profile light 100 was installed, either in a recessed luminaire housing, a junction box, or the like. Because lighting devices such as the low profile light 100 are typically installed in a ceiling, so as to illuminate an area beneath the ceiling, this view is said to be a ceiling facing view. However, this term is used for convenience of description only and is not limiting. That is, a low profile light according to embodiments described throughout may be installed in other surfaces that are not ceilings. The view shown in FIG. 1, whatever the surface the low profile light 100 is installed in, is the portion generally not visible. The low profile light 100 includes one or more solid state light sources 102 and a cover 104 (both not visible in FIG. 1 but shown in FIG. 2). The cover 104 is disposed in relation to the one or more solid state light sources 102, such that light emitted by the one or more solid state light sources 102 passes through the cover 104. The cover 104, in some embodiments, is made of a semi-transparent, diffusive material. The low profile light also includes a driver 106, which is contained within a driver housing 108. Due to the driver housing 108, it is not possible to see the driver itself 106 in FIG. 1. The driver 106 is any driver or power supply that supplies electrical power to the one or more solid state light sources 102. The driver 106 itself receives power via a wire 109, which in some embodiments as shown in FIG. 1 is attached to a screw base 110 capable of interfacing with a typical electrical lamp socket.

The low profile light 100 also includes a housing 120. The housing 120 provides structure for the low profile light 100. The housing 120 includes a central portion 122 and a lip 124. The central portion 122 has a first side 126 (not shown in FIG. 1 but shown in FIG. 2) and a second side 128. The lip 124 extends around an outer edge 128 of the housing 120. The housing 120 also includes a cover receptacle 130 configured to receive the cover 104 and an outer face 132 (neither shown in FIG. 1 but shown in FIG. 2). The outer face 132 extends from the lip 124 inward towards the cover receptacle 130. The housing 120 also includes an inner surface 134, which extends downward away from the central portion 122 and upward towards the lip 124, so as to form a valley 136, as seen in FIG. 1. The housing 120 also includes a fin 138, which extends perpendicularly up from the central portion 122.

Figure 2:
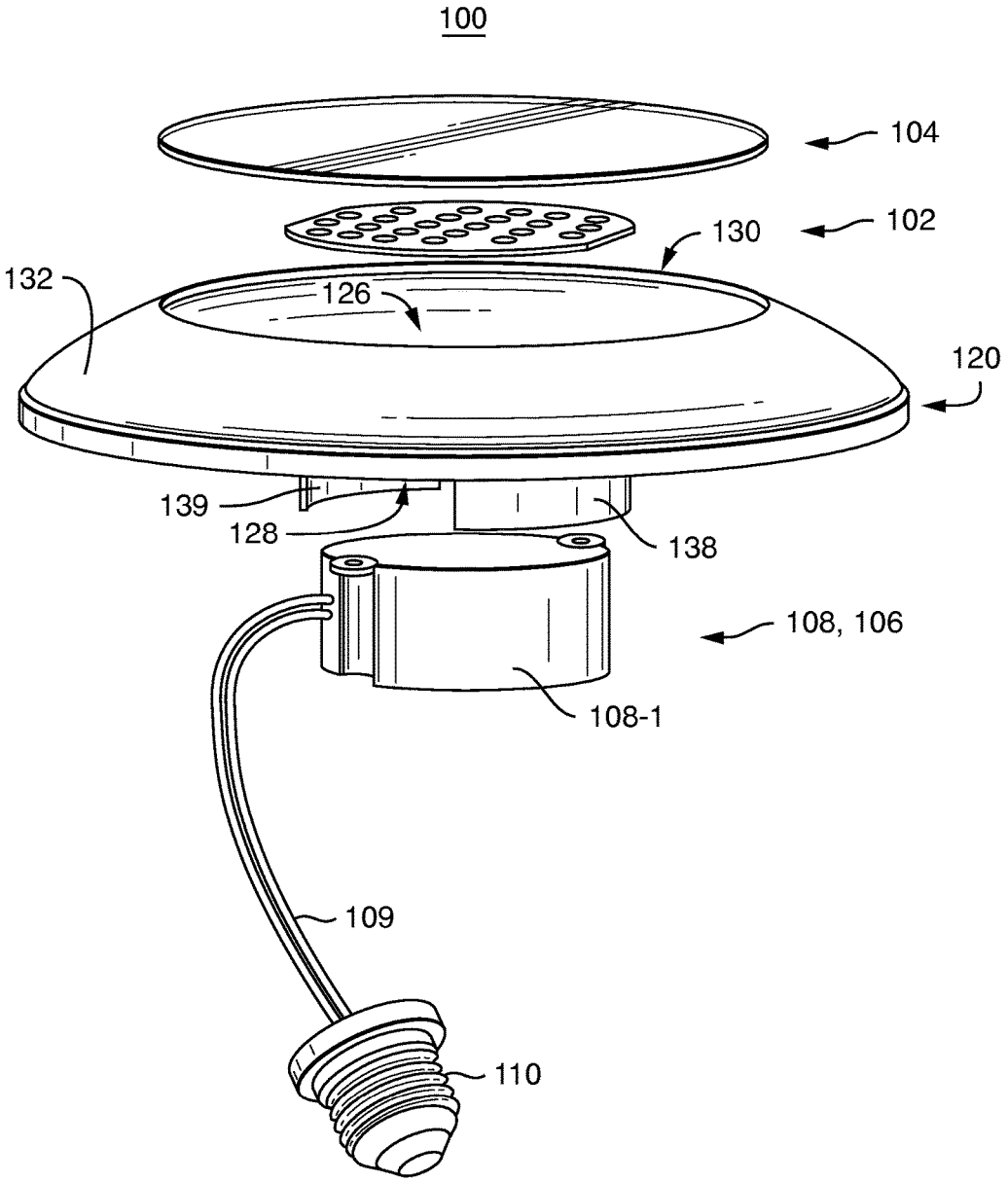
FIG. 2 illustrates various components of the low profile light of FIG. 1, including how they fit together, according to embodiments disclosed herein.
Figure 3:
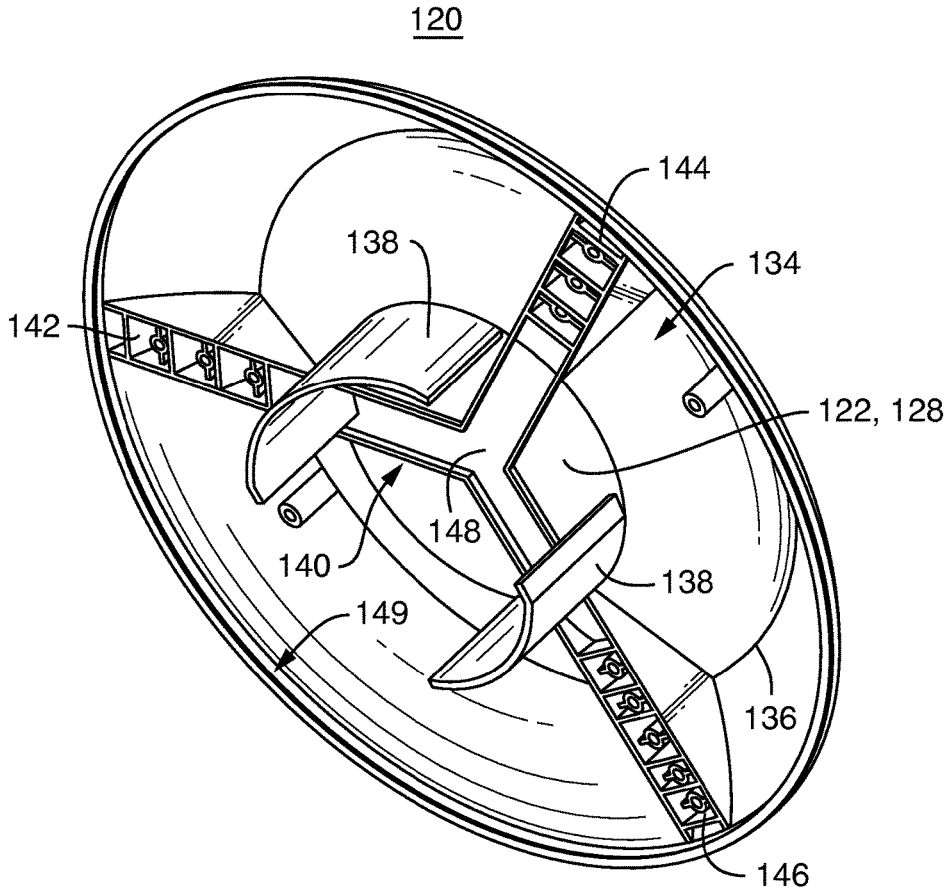
FIG. 3 shows a rear ceiling facing perspective view of an embodiment of the housing of the low profile light according to embodiments disclosed herein.
Figure 4A:
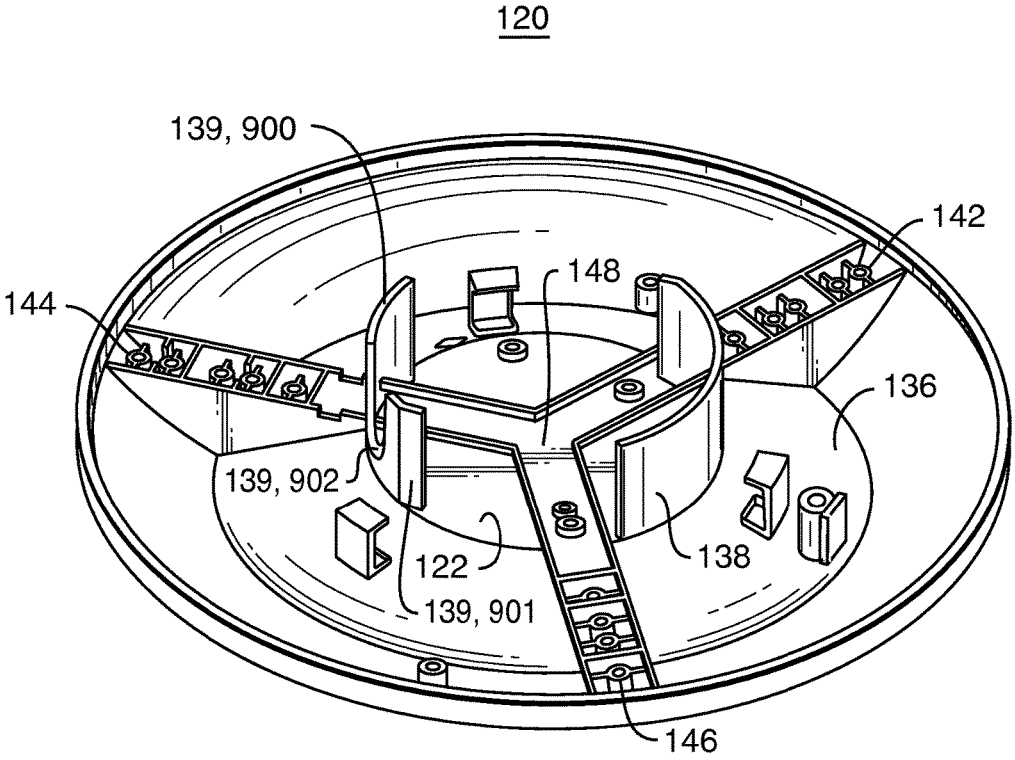
FIGS. 4A-4B show other rear ceiling facing views of embodiments of the housing of the low profile light according to embodiments disclosed herein.
Figure 4B:
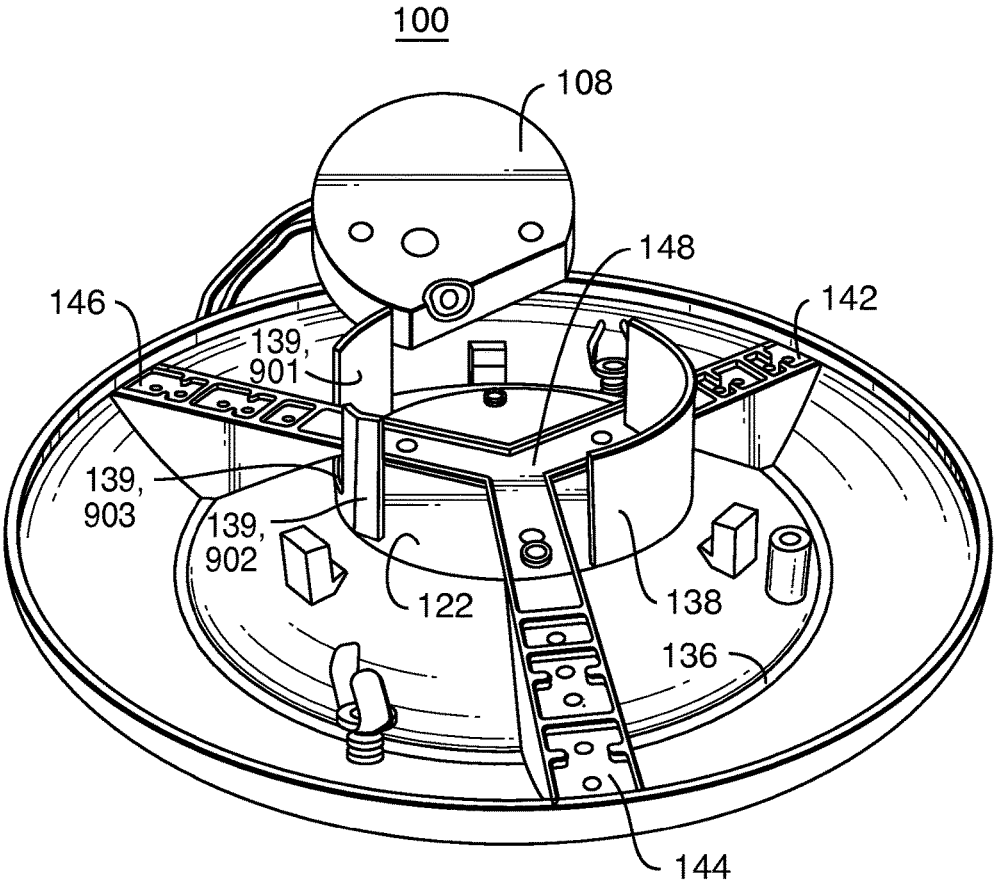

The central portion 122, in some embodiments, is substantially flat. As shown in FIG. 2, in some embodiments, the central portion 122 is substantially flat on the first side 126. Similarly, in some embodiments as shown in FIGS. 3, 4A, and 4B, the second side 128 of the central portion 122 includes a raised portion 140. In some embodiments, as shown in FIGS. 3, 4A, and 4B, the raised portion 140 is a Y-shaped raised portion 140 formed of three legs 142, 144, 146. The three legs 142, 144, 146, in some embodiments, meet at a center 148 of the second side 128 of the central portion 122. In some embodiments, the three legs 142, 144, 146 each terminate at the central portion 122. The three legs 142, 144, 146, in some embodiments, each extend beyond the central portion 122 to an inner edge 148 of the lip 124. The three legs 142, 144, 146 provide structural support for the housing 120 as well as enabling various connection systems (not shown) for the low profile light 100.

FIG. 2 shows an embodiment of the low profile light 100 with some of its component parts separated, so as to show how these connect together. Thus, FIG. 2 includes the cover 104, the one or more solid state light sources 102, the housing 120, the driver housing 108 (with the driver 106 contained therein), and the wire 109 with attached screw base 110. As seen in FIG. 2, the one or more solid state light sources 102 are coupled to the first side 126 of the central portion 122 and the driver housing 108 is coupled to the second side 128 of the central portion 122.

As shown throughout the figures, the fin 138 is integrally formed with the central portion 122 of the housing 120. In other words, the fin 138 is not a separate part of the housing 120 that could be mechanically unattached and then reattached without anything more. To remove the fin 138 from the housing 120 would require breaking the fin 138 off of the housing 120. In some embodiments, all of the components of the housing (i.e., the central portion 122, the lip 124, the cover receptacle 130, the outer face 132, the inner surface 134, and the fin 138) are all integrally formed as a single piece. In some embodiments, the central portion 122, the lip 124, the cover receptacle 130, the outer face 132, the inner surface 134, and the fin 138 are integrally formed of the same material, such as but not limited to any known type of metal or plastic.

As shown throughout the figures but most clearly in FIG. 3, the fin 138 of the housing 120 is, in some embodiments, substantially curved. As shown in FIGS. 1 and 2, in some embodiments, the driver housing 108 is correspondingly curved. That is, an arc of the fin 138 is similar to an arc of the driver housing 108. As is seen in FIGS. 1 and 2, in some embodiments, the entirety of the driver housing 108 is not curved, but only portions thereof.

FIGS. 4A and 4B show embodiments of the low profile light 100 that include a first fin 138 and a second fin 139. As shown the first fin 138 is shaped to at least partially surround a first portion 108-1 of the driver housing 108. Similarly, the second fin 139 is shaped to at least partially surround a second portion 108-2 of the driver housing 108. In some embodiments, as shown in FIGS. 4A and 4B, the second fin 139 comprises a first raised portion 900, a second raised portion 901, and a connecting portion 902. The connecting portion 902 joins the first raised portion 900 to the second raised portion 901. In some embodiments, the connecting portion 902 is lower in height than the first raised portion 900 and the second raised portion 901. In some embodiments, the connecting portion 902 is lower in height than one of the first raised portion 900 and the second raised portion 901. In some embodiments, the connecting portion 902 is substantially the same height as one of or both of the first raised portion 900 and the second raised portion 901. In some embodiments, the lowered height of the connecting portion 902 is configured to receive the wire 109 extending from the driver housing 108 to a power source for the low profile light 100.

Though embodiments have been described as having one or two fins, embodiments are not so limited. Indeed, any number of perpendicularly extending fins that are integrally formed with the central portion of the housing are possible without departing from the scope of this disclosure.

Measurements were taken of two versions of a low profile light according to embodiments disclosed herein. One version required 10 W to operate and the other version required 13 W to operate. Each version was tested while lacking one or more upwardly extending fins as disclosed herein, and while having such one or more such fins. The measurements are shown in Table 1 below and indicate a drop in temperature both at the one or more solid state light sources and at the housing.

TABLE 1

| | Temperature at one or more solid state light sources (T1) | Temperature at housing (T2) | Change in T1 | Change in T2 |
|---|---|---|---|---|
| 10 W, no fin | 52.8° C. | 38.8° C. | | |
| 10 W, with fin | 50.6° C. | 37° C. | 2.2° C. | 1.8° C. |
| 13 W, no fin | 61.1° C. | 44.9° C. | | |
| 13 W, with fin | 57.9° C. | 42.2° C. | 3.2° C. | 2.7° C. |

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A low profile light, comprising:

one or more solid state light sources;

a cover disposed in relation to the one or more solid state light sources such that light emitted by the one or more solid state light sources passes through the cover;

a driver to supply electrical power to the one or more solid state light sources, wherein the driver is contained within a driver housing; and a low profile light (LPL) housing comprising:

a central portion having a first side and a second side;

a lip, wherein the lip extends around an outer edge of the LPL housing;

a cover receptacle configured to receive the cover;

an outer face, wherein the outer face extends from the lip inward towards the cover receptacle;

an inner surface, wherein the inner surface extends downward away from the central portion and upward towards the lip, so as to form a valley; and a fin, extending perpendicularly up from and engaged to the central portion and independent of the driver housing, wherein the fin is of curved configuration and is configured to at least partially surround a correspondingly curved exterior portion of the driver housing when the driver housing is hosted by the LPL housing, and wherein the fin is not configured to hold the driver housing in contact with the LPL housing.

2. The low profile light of claim 1, wherein the central portion of the LPL housing is substantially flat.

3. The low profile light of claim 1, wherein the central portion of the LPL housing is substantially flat on the first side.

4. The low profile light of claim 3, wherein the central portion of the LPL housing includes a raised portion on the second side.

5. The low profile light of claim 4, wherein the raised portion comprises a Y-shaped raised portion formed of three legs, wherein the three legs meet at a center of the second side of the central portion, and wherein the three legs each extend beyond the central portion to an inner edge of the lip.

6. The low profile light of claim 1, wherein the one or more solid state light sources are coupled to the first side and the driver housing is coupled to the second side.

7. The low profile light of claim 1, wherein the fin is integrally formed with the central portion of the LPL housing.

8. The low profile light of claim 1, wherein the fin comprises a first fin and a second fin, wherein:

the first fin is of curved configuration and configured to at least partially surround a correspondingly curved first exterior portion of the driver housing when the driver housing is hosted by the LPL housing; and the second fin is of curved configuration and configured to at least partially surround a correspondingly curved second exterior portion of the driver housing when the driver housing is hosted by the LPL housing.

9. The low profile light of claim 8, wherein the second fin comprises a first raised portion, a second raised portion, and a connecting portion that joins the first raised portion to the second raised portion.

10. The low profile light of claim 9, wherein the connecting portion is lower in height than the first raised portion and the second raised portion.

11. The low profile light of claim 10, wherein the lowered height of the connecting portion is configured to receive a wire extending from the driver housing to a power source for the low profile light.

12. The low profile light of claim 8, wherein the LPL housing is configured such that the driver housing is disposed concentrically interior of both the first fin and the second fin when the driver housing is hosted by the LPL housing.

13. The low profile light of claim 1, wherein the central portion, the lip, the cover receptacle, the outer face, the inner surface, and the fin are integrally formed.

14. The low profile light of claim 13, wherein the central portion, the lip, the cover receptacle, the outer face, the inner surface, and the fin are integrally formed of the same material.

15. The low profile light of claim 1, wherein the fin is dimensioned such that it extends from the central portion of the LPL housing and terminates on a sidewall of the driver housing without reaching an end of the driver housing when the driver housing is hosted by the LPL housing.

16. The low profile light of claim 1, wherein:

the driver housing includes an exterior portion that is not curved; and the fin is configured to at least partially surround the exterior portion that is not curved when the driver housing is hosted by the LPL housing.

17. The low profile light of claim 1, wherein the fin comprises:

a first section, which is of the curved configuration; and a second section of straight configuration, which extends away from the first section at an angle.

18. The low profile light of claim 1, wherein the fin has a recess defined therein that is configured to receive a wire extending from the driver when the driver housing is hosted by the LPL housing.

19. The low profile light of claim 18, wherein at least one of:

the recess is generally U-shaped; and the recess extends only partway within the fin toward the central portion.

20. The low profile light of claim 1, wherein the LPL housing is configured such that the driver housing is disposed concentrically interior of the fin when the driver housing is hosted by the LPL housing.

* * * * *